US006367100B2

(12) United States Patent
Koren et al.

(10) Patent No.: US 6,367,100 B2
(45) Date of Patent: Apr. 9, 2002

(54) WATERFALL WITH LOCKING UPPER AND LOWER LIPS AND AN ANGLED EXTRUSION ARM COMBINED WITH A SCREEN

(76) Inventors: Pinhas P. Koren, 640 E. Alpine, Altamonte Springs, FL (US) 32701; Richard Heiner, 14554 Grassy Cover Cir., Orlando, FL (US) 32824

( * ) Notice: Subject to any disclaimer, the term of this patent is extended or adjusted under 35 U.S.C. 154(b) by 0 days.

(21) Appl. No.: 09/740,772

(22) Filed: Dec. 19, 2000

Related U.S. Application Data

(63) Continuation-in-part of application No. 09/084,651, filed on May 26, 1998, now abandoned.

(51) Int. Cl.[7] ..... E04H 4/00
(52) U.S. Cl. ..... 4/507; 239/17
(58) Field of Search ..... 4/507; 239/17, 239/293, 510

(56) References Cited

U.S. PATENT DOCUMENTS 5,249,744 A * 10/1993 Ruthenberg ..... 4/507 X
5,738,280 A * 4/1998 Ruthenberg ..... 239/17
5,893,179 A * 4/1999 Johnson ..... 4/507

* cited by examiner

*Primary Examiner*—Charles E. Phillips
(74) *Attorney, Agent, or Firm*—Terry M. Sanks, Esq.; Beusse Brownlee Bowdoin & Wolter, PA

(57) ABSTRACT

A waterfall apparatus comprising a water confining base, said base including a bottom and a plurality of upwardly extending side walls connected to said bottom; a water inlet connected to said base for providing a path of travel for water entering said base; a water outlet connected to said base, said water outlet including an upper lip connected to at least a first one of said plurality of side walls and extending outwardly therefrom, and a lower lip spaced apart from said upper lip, connected to at least to a second one of said plurality of side walls, and extending outwardly therefrom so that water positioned within said base flows between said upper and lower lips and outwardly and downwardly therefrom; a water flow guiding arm connected to said base and extending downwardly at a predetermined angle therefrom into the inner confines of said base to provide a water flow path of travel from said water inlet, around said guiding arm and from said water outlet, the predetermined angle being less than 90 degrees; and a removable screen extending from said guiding arm to said base.

20 Claims, 6 Drawing Sheets

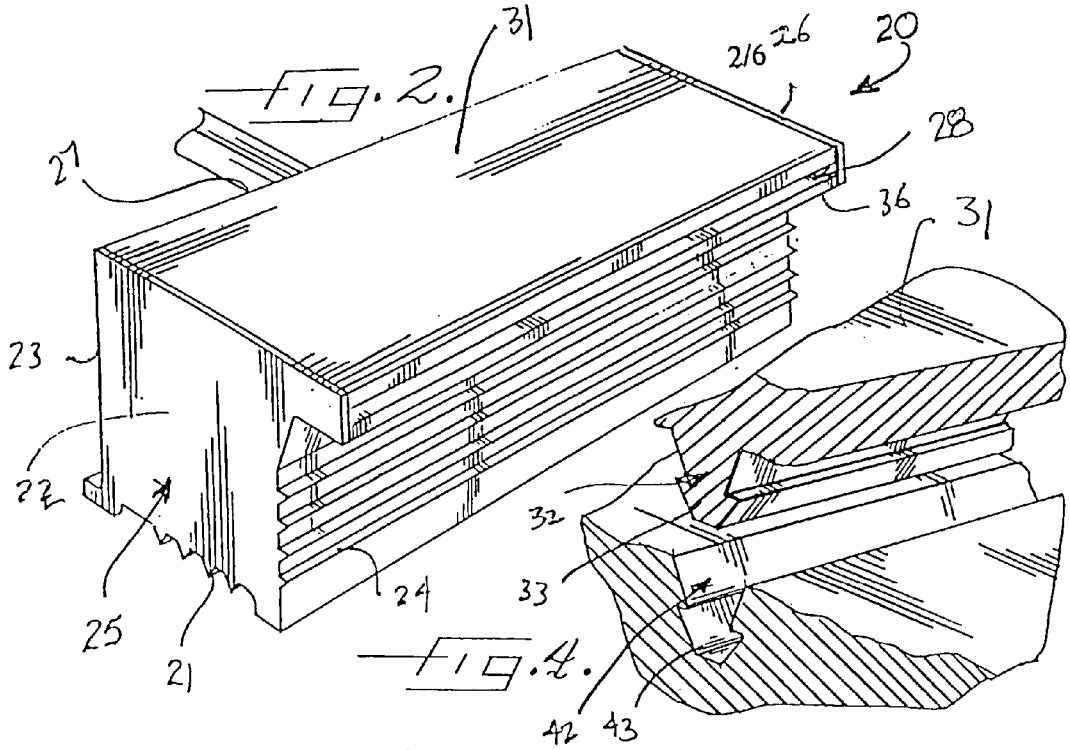
Fig. 2.
Fig. 4.
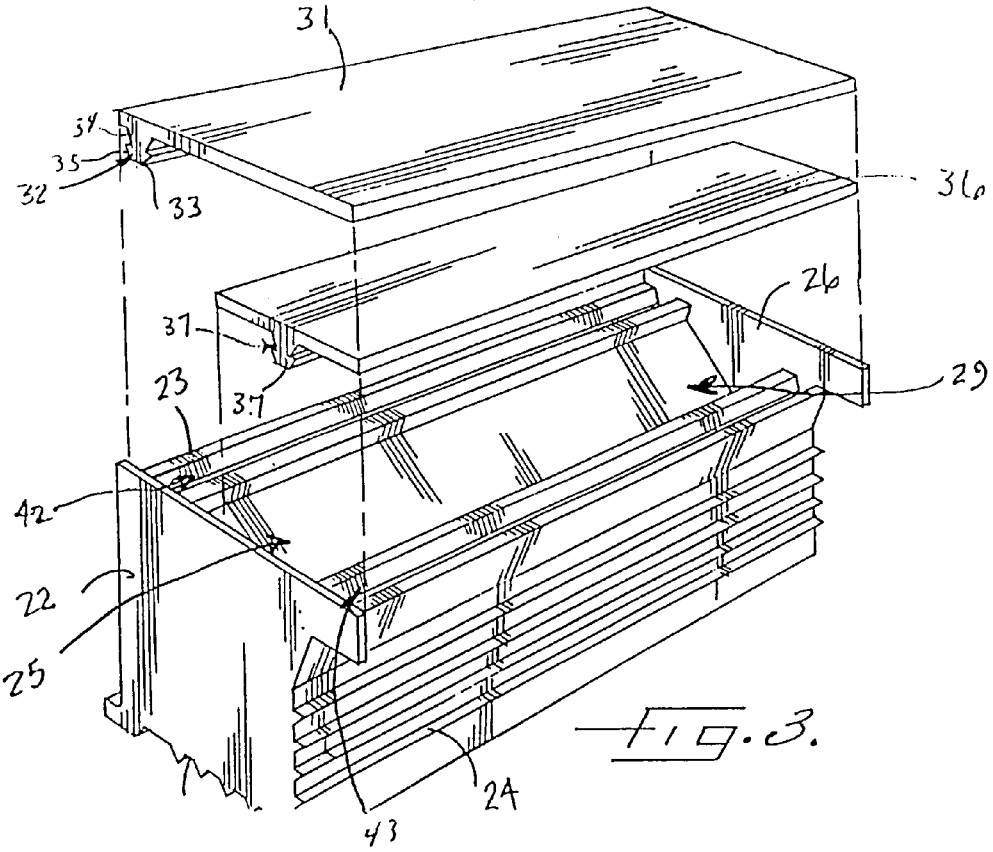
Fig. 3.

WATERFALL WITH LOCKING UPPER AND LOWER LIPS AND AN ANGLED EXTRUSION ARM COMBINED WITH A SCREEN

This is a continuation-in-part application of application Ser. No. 09/084,651 filed May 26, 1998, now abandoned.

BACKGROUND OF THE INVENTION

The invention relates to the industries of leisure, recreation, and aesthetic appearance of water arrangements in pools, ponds, or spas and, more particularly, to the field of decorative waterfalls or fountains for water pools, ponds, or spas in these industries.

For aesthetic appearance, waterfalls or waterfall arrangements are often used in a swimming pool, pond, spa, or the like. The water is often drawn from the pool and passes over the edge of a wall or a weir of the pool. Various configurations of these waterfalls have been developed over the years. Some of the waterfalls include pumping or drawing water into a lower portion of a body of the pool or basin structure and allowing the water to fall from an upper portion thereof as the water fills or continues to fill the body. The water falls or descends over an edge of a wall or opening to another pool of water or conduit positioned at a lower elevation. Some examples of such waterfalls can be seen in U.S. Pat. No. 5,309,581 by Lockwood et al. titled "Water Steam Apparatus," U.S. Pat. No. 5,388,285 by Belniak titled "Swimming Pool Waterfall," and U.S. Pat. No. 5,537,696 by Chartier titled "Apparatus For Producing Sheet Waterfall For Pool Or Spa." Problems with controlling the water flow into, through, and from the body of the pool or spa continually need to be more efficiently addressed, including in different types or style structures. Additionally, aesthetic appearance of these waterfalls are often desired by those in the industry as well as owners of the waterfalls.

Generally rectangular-shaped waterfall basins also are known where water flows into a lower portion thereof and out from a pair of spaced-apart lips positioned along an upper portion thereof An example of such a waterfall apparatus can be seen in U.S. Pat. No. 4,881,280 by Lesikar titled "Waterfall Producing Unit For Use In Swimming Pools" and U.S. Pat. No. 5,249,744 by Ruthenberg titled "Apparatus For Creating Waterfall For Swimming Pools." These known waterfall basins or bases, however, have problems, for example, with the lips breaking by excessive pressure thereon such as during installation, the lips causing handling problems, or the lips not remaining secure to the base when positioned thereon.

SUMMARY OF THE INVENTION

In view of the foregoing background, the present invention advantageously provides a waterfall apparatus and associated method for more efficiently controlling water flow within and from a waterfall arrangement. The present invention also advantageously provides a waterfall apparatus and associated methods which enhance the aesthetic appearance of waterfall arrangements. The present invention additionally advantageously provides a design and construction of a waterfall apparatus which can be mass produced less expensively and more easily handled and installed in various installations. The present invention further provides a waterfall apparatus having an outlet portion thereof which detachably secures an outlet region, e.g., such as provided by a pair of spaced-apart lips, to a base thereof.

More particularly, an embodiment of the present invention provides a waterfall apparatus comprising a water confining base, the base including a bottom and a plurality of upwardly extending side walls connected to said bottom, a first one of said plurality of side walls extending upwardly from said bottom a greater distance than a second one of said plurality of side walls, a water inlet connected to a lower portion of the base for providing a path of travel for water entering the base, a water outlet connected to an upper portion of the base. The present invention also includes the water outlet including an upper lip connected to the first one of the plurality of side walls and extending outwardly therefrom, and a lower lip spaced-apart from the upper lip, connected to the second one of the plurality of side walls, and extending outwardly therefrom so that water positioned within said base flows between the upper and lower lips and outwardly and downwardly therefrom. A water flow guiding arm is connected to an upper portion of one of said plurality of side walls of the base and extending downwardly at a predetermined angle therefrom into the inner confines of the base to provide a water flow path of travel from the water inlet, around the guiding arm and from the water outlet, the predetermined angle being less than 90 degrees, and a removable screen extends from the guiding arm and transversely extends to the base.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 2 is a perspective view of a waterfall apparatus according to an embodiment of the present invention;

FIG. 3 is an exploded perspective view of a waterfall apparatus according to an embodiment of the present invention;

FIG. 4 is an enlarged perspective view of a first embodiment of legs of respective upper and lower lips of a waterfall apparatus according to the present invention;

DETAILED DESCRIPTION OF THE INVENTION

The present invention will now be described more fully hereinafter with reference to the accompanying drawings, in which preferred embodiments of the invention are shown.

This invention may, however, be embodied in many different forms and should not be construed as limited to the embodiments set forth herein. Rather, these embodiments are provided so that this disclosure will be thorough and complete, and will fully convey the scope of the invention to those skilled in the art. Prime or multiple prime notation, if used, indicates alternative embodiments. Like numbers refer to like elements throughout.

Figure 1:
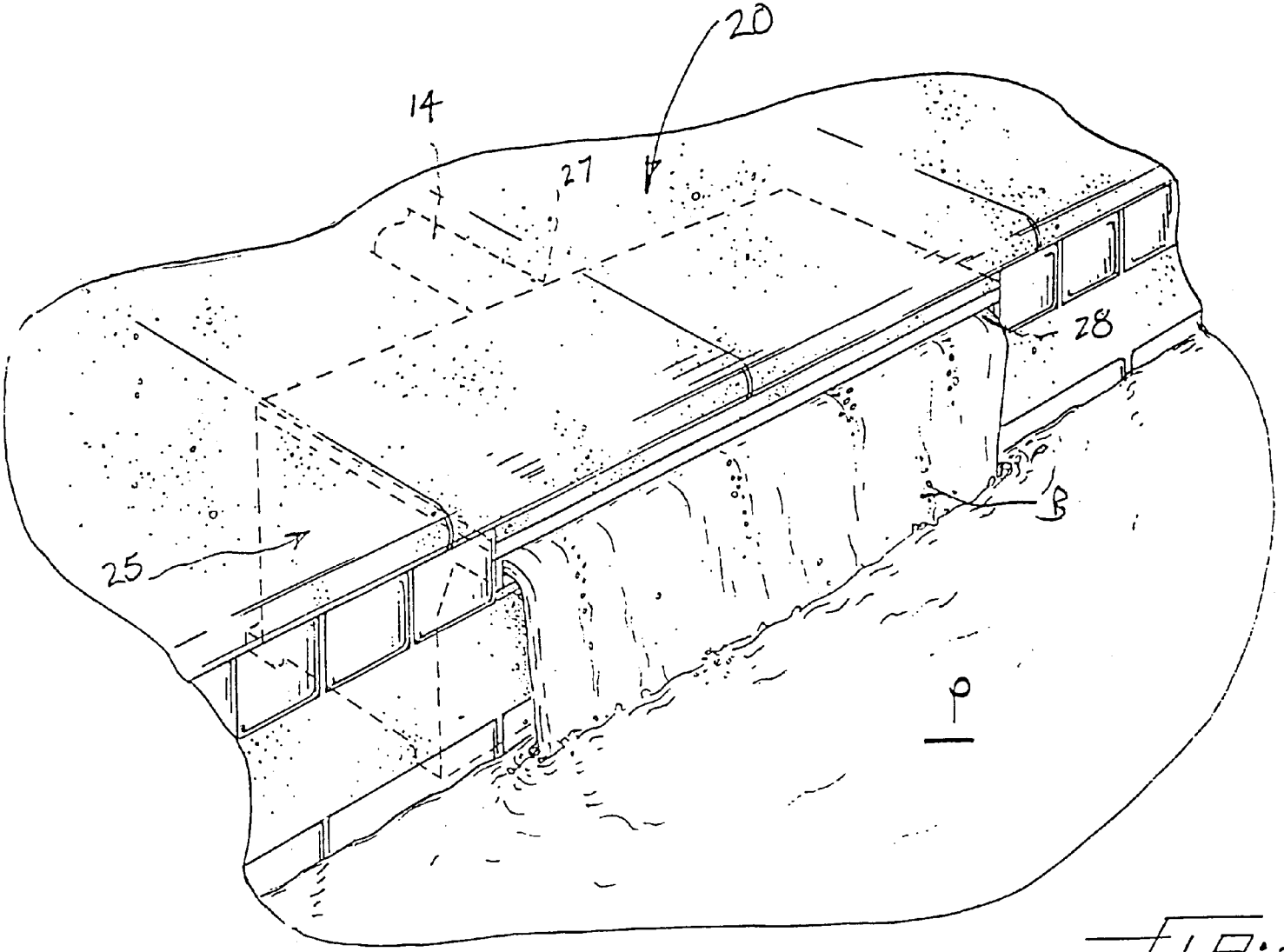
FIG. 1 an environmental perspective view of a waterfall apparatus according to an embodiment of the present invention.
Figure 11:
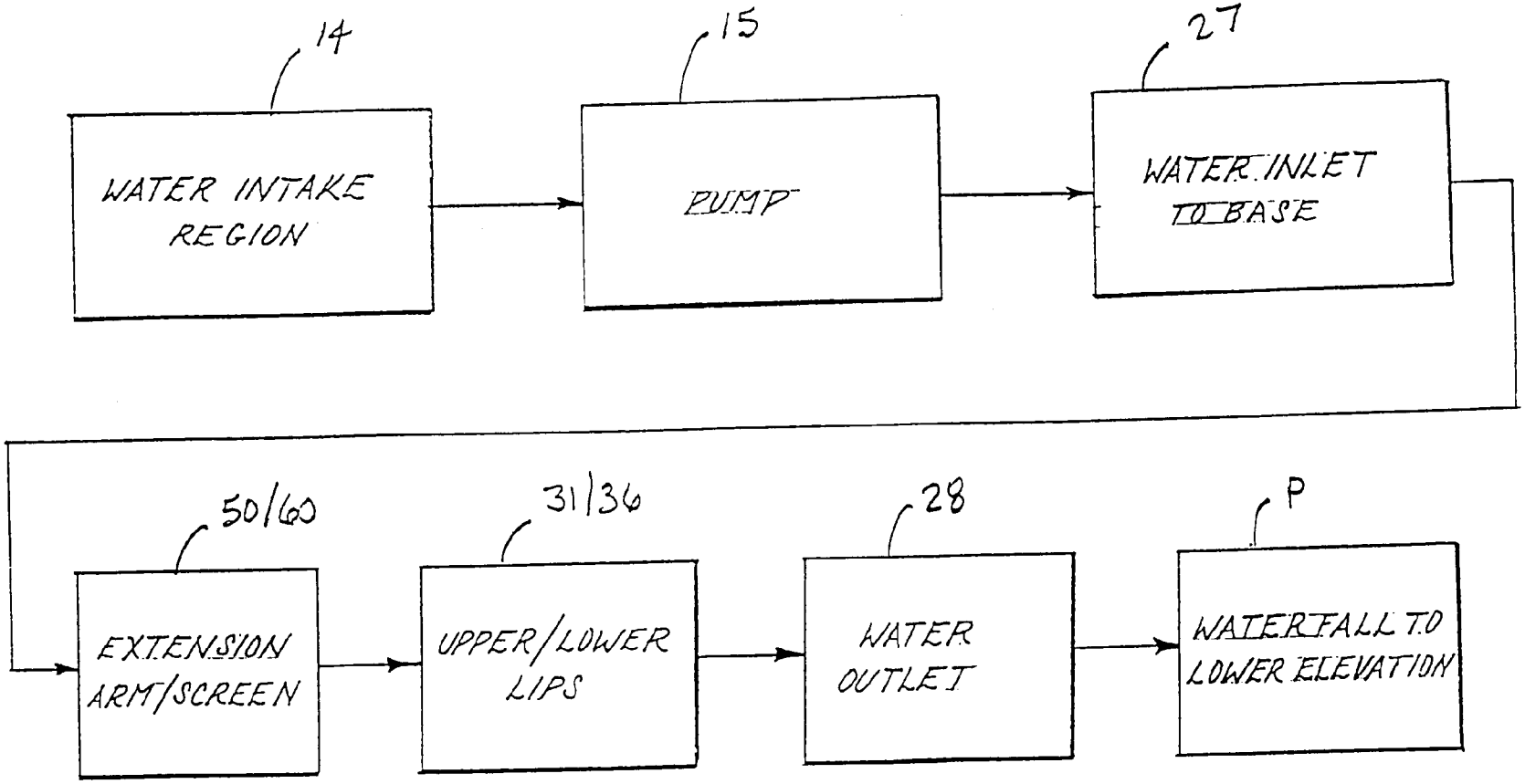
FIG. 11 is a schematic block diagram of a waterfall apparatus according to an embodiment of the present invention.

FIGS. 1–2 and 11 illustrate a waterfall apparatus 20 according to the present invention. FIG. 1, for example, illustrates an environmental view of the waterfall apparatus, such as illustrated in the perspective view of FIG. 2, installed is a swimming pool P for enhanced aesthetic appearance. The waterfall apparatus 20 preferably includes a water confining basin or base 25. The base 25 includes a bottom 21 and a plurality of upwardly extending side walls 22, 23, 24, 26 connected to the bottom 21 and extending upwardly therefrom when in a generally upright or vertically oriented position. A first one 23, e.g., also a rear wall, of the plurality of side walls 22, 23, 24, 26 extends upwardly from the bottom 21 a greater distance than a second one 24, e.g., also a front wall, of the plurality of side walls 22, 23, 24, 26. The waterfall apparatus 20 also preferably includes a water inlet 27, e.g., an opening connected to a pipe or other water conduit 14 and preferably has a relatively small diameter, connected to a lower portion of the base 25 for providing a path of travel for water entering the base 25 and a water outlet 28, e.g., an opening which is preferably narrow and elongate as illustrated, connected to an upper portion of the base 25. The water outlet 28 includes an upper lip 31 connected to the first one 23 of the plurality of side walls preferably along the upper peripheries thereof and extends outwardly therefrom. A lower lip 36 is positioned to be spaced-apart from the upper lip 31, connects to the second one 24 of the plurality of side walls along the upper peripheries thereof, and extends outwardly therefrom so that water positioned within the base 25 flows between the upper and lower lips 31, 36 as illustrated and outwardly and downwardly therefrom. The upper and lower surfaces of the lips 31, 36 are preferably substantially planar as illustrated, except for the legs 33, 37 as illustrated in FIG. 3 and described further herein below. As understood by those skilled in the art, a pump 15 is preferably positioned in fluid communication with the water inlet 27, the base 25, and the water outlet 28 for pumping fluid such as water therethrough (see, e.g., FIG. 13).

Figure 6:
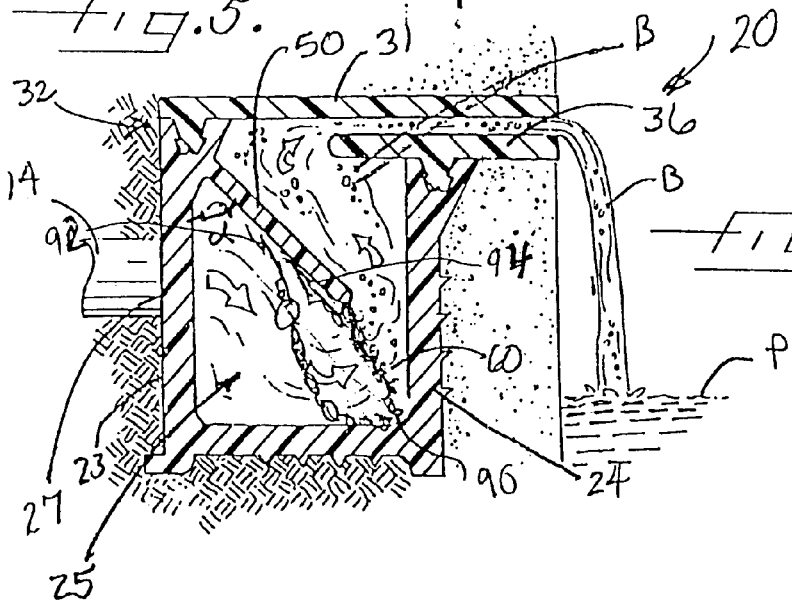
FIG. 6 is a vertical sectional view taken along line 6—6 of FIG. 5 of a waterfall apparatus according to a first embodiment of the present invention.
Figure 7:
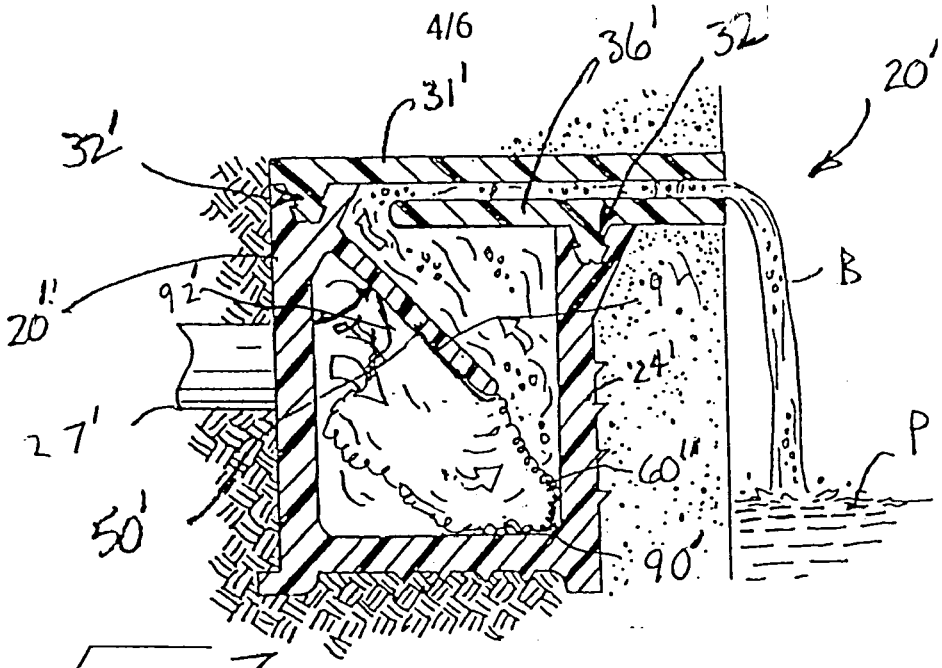
FIG. 7 is a vertical sectional view of a waterfall apparatus according to a third embodiment of the present invention.
Figure 8:
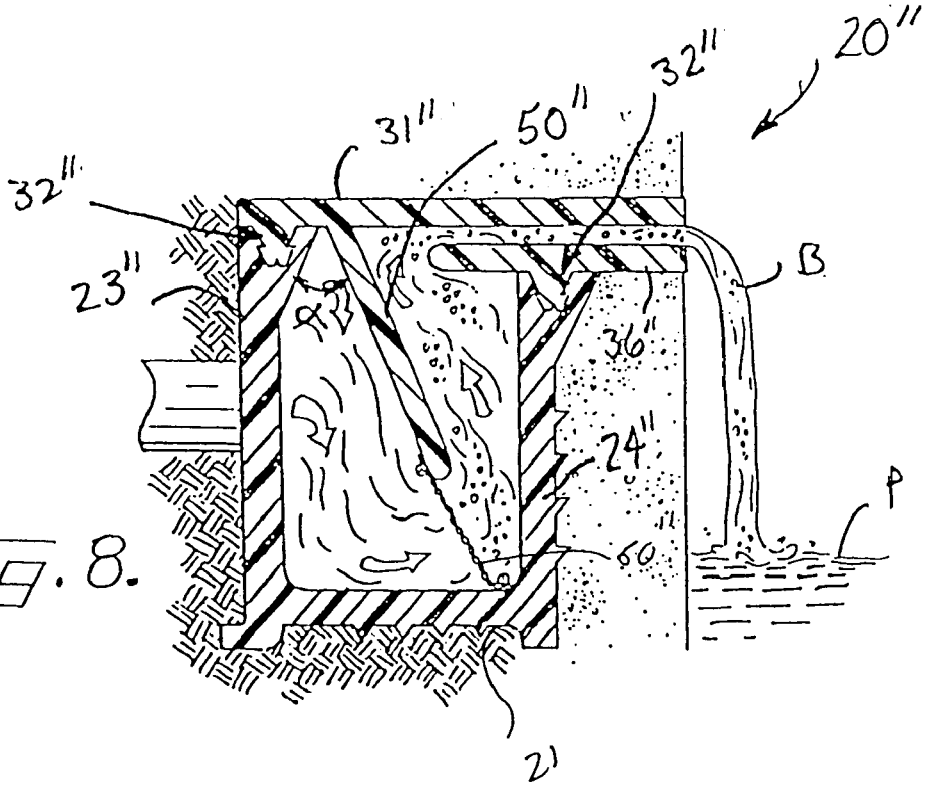
FIG. 8 is a vertical sectional view of a waterfall apparatus according to a fifth embodiment of the present invention.
Figure 10:
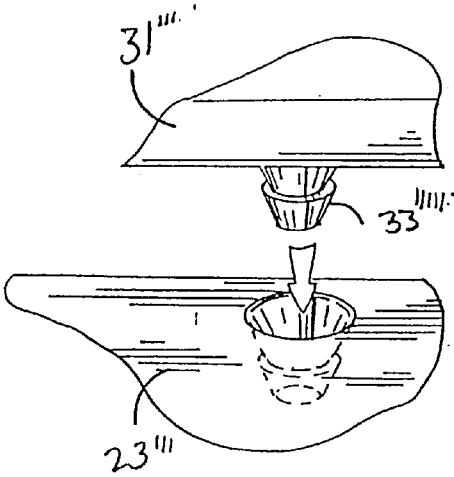
FIG. 10 is an enlarged perspective view of a second embodiment of legs of respective upper and lower lips of a waterfall apparatus according to the present invention.
Figure 9:
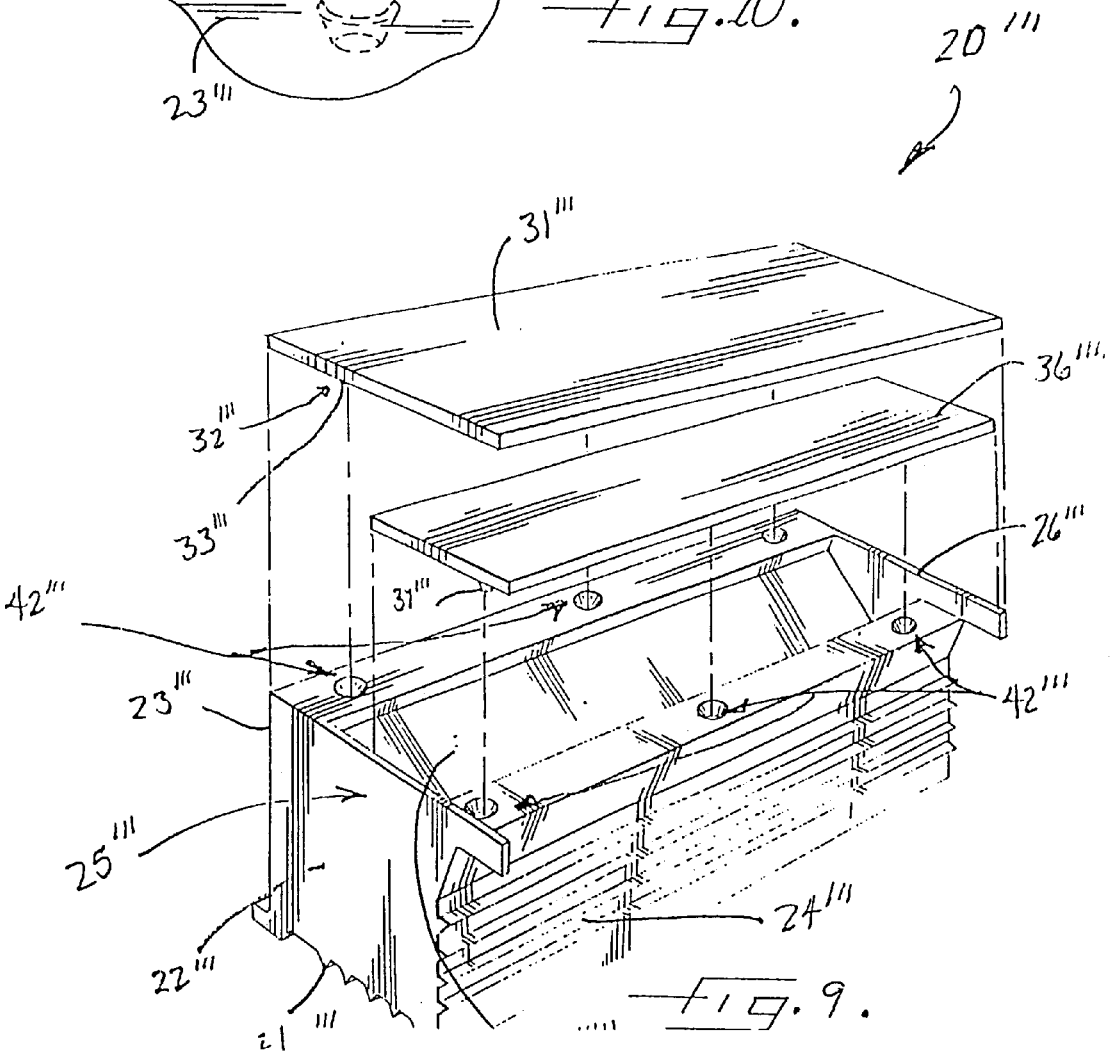
FIG. 9 is an exploded perspective view of a waterfall apparatus according to yet another embodiment of the present invention.

As is illustrated in FIGS. 6–8, the waterfall apparatus 20 of the present invention additionally includes a water flow guiding arm 50 connected to an upper portion of one 23 of the plurality of side walls 22, 23, 24, 26 of the base 25 and extends downwardly at a predetermined angle therefrom into the inner confines, i.e., into the region or cavity where the water flows, of the base 25 to provide a water flow path of travel from the water inlet 27, around the guiding arm 50 and from the water outlet 28. The guiding arm 50 preferably breaks the water flow path of travel as the water, e.g., a heavy stream or under high pressure, enters the base 25 from the water inlet 27. Accordingly, the guiding arm 50 is preferably strong enough, e.g., thickness or mass, to divert or handle the water when supplied to the base 25 from the water inlet 27 without fracturing the arm 50.

Figure 5:
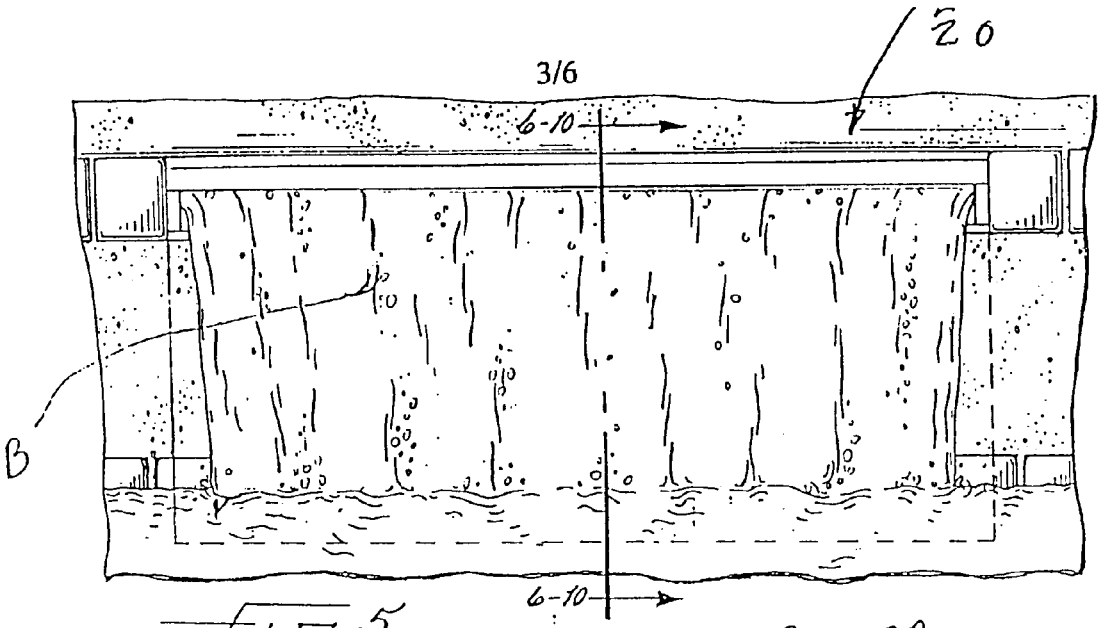
FIG. 5 is a front elevational view of a waterfall apparatus according to a first embodiment of the present invention.

As further illustrated in FIGS. 6–8, the guiding arm 50 preferably directs the water flow downwardly so that as the volume of water increases in the base 25, the water slowly rises on the other side of the guide arm 50 and to the water outlet 28. In this manner, the guiding arm 50 itself and the position of the guiding arm 50 assists in the control or managing the water flow so that water flows from the water outlet 27 in a smooth, controlled or regulated manner, and with an aesthetically pleasing appearance (see FIGS. 1, 5, and 11). The predetermined angle a of the guiding arm 50 is preferably less than 90 degrees, and more preferably within 30–70 degrees, e.g., about 40 degrees, as measured between the surface of the side wall 23 to which the guiding arm 50 is connected and the lower side of the guiding arm 50, e.g., the angle a in the triangle formed by plane extending along the bottom 21 of the base 25, the side wall 23 to which the arm 50 is connected, and the projected plane from the guiding arm 50 to the bottom plane. The lower lip 36 also preferably includes portions which extend inwardly into the inner confines of the base 25 so that water flows from the water inlet 27, around the guiding arm 50, around the inwardly extending portions of the lower lip 36 and outwardly through the water outlet 28. The guiding arm 50 is preferably extruded as a single integral piece with the first one 23, e.g., the rear wall, of the plurality of walls and can advantageously be formed in various embodiments of a waterfall apparatus 20, 20', 20" such as illustrated in FIGS. 6–8. For example, the guiding arm 50 preferably includes at least a substantially planar proximal portion, but the entire guiding arm 50, 50', 50" can be substantially planar such as illustrated in the cross sectional views of the embodiments of FIGS. 6–8.

Additionally, the waterfall apparatus 20 can advantageously include a screen 60, e.g., a metal or plastic mesh or sheet having a plurality of openings therein, positioned adjacent the extension or guiding arm 50 and transversely extend across the base 25 to assist the guiding arm 50 in the control or managing the water flow so that water flow from the outlet 27 is a smooth, controlled or regulated manner, and with an aesthetically pleasing appearance. The screen may also generate gaseous bubbles B in water flowing through the screen 60 and from the water outlet 28 (see FIGS. 5–8). The screen 60 can also trap debris thus preventing debris from becoming wedged between the upper lip 31 and lower lip 36, which could result in the waterfall apparatus 20 not operating properly. For debris trapped behind the screen, the upper lip 31 can be removed, as discussed below, and the screen removed to get to the trapped debris.

The screen 60", for example as illustrated in FIG. 8, can advantageously be connected to the guiding arm 50" and a side wall 24" or the bottom 21" of the base 25", e.g., with a fastener, as illustrated, can advantageously be a separate screen or screening device which is mounted as a stand alone device which preferably transversely extends across the inner confines of the base, or can be another screen device or orientation which generates the desired bubbles B or air pockets in the water as understood by those skilled in the art.

In another preferred embodiment, as illustrated in FIGS. 6 and 7, a single screen is folded in half where the screen has a concave shape 60, 60'. When placed into the waterfall apparatus 20, 20' the area of the fold, or apex 90, 90' makes contact with the base 21, 21' and a side wall proximate the base. The ends of the folded screen 92, 92', 94, 94' are held in place against the guiding arm 50, 50'. The screen in these embodiments is held in place by the screen applying force to the inner walls as it tries to expand to its original shape. In another embodiment, both ends of the screen are connected to the guiding arm 50, 50'. The openings in the screen can be formed where the openings on one side of the concave shape has different sized openings than the openings on the other side of the concave screen. The screen 60, 60' in conjunction with and the position of the guiding arm 50, 50' assists in the control or managing the water flow so that water flows from the water outlet 27, 27' in a smooth, controlled or regulated manner, and with an aesthetically pleasing appearance (see FIGS. 1, 5, and 11).

As perhaps best illustrated in FIGS. 3–4 and 9–10, the waterfall apparatus 20, 20''' further has lip detachable connecting means 32, 32''' connected to each of the upper and lower lips 31, 31''', 36, 36''' and the basin 25, 25''' for detachably connecting each of the upper and lower lips 31, 31''', 36, 36''' to the basin 25, 25'''. The lip detachable connecting means 32, 32''' preferably includes at least one leg 33, 33''', 37, 37''' connected to, e.g., integrally molded as a single piece, and extending outwardly from each of the upper and lower lips 31, 31''', 36, 36'''. The at least one leg 33, 33''', 37, 37''' advantageously includes a relatively narrow proximal portion 34 and a relatively thicker distal portion 35 and leg mating means 42, 42''' formed integrally with the first and second ones 23, 23''', 24, 24''' of the plurality of side walls 22, 22''', 23, 23''', 24, 24''', 26, 26''' for matingly receiving the at least one leg 33, 33''', 37, 37'''. The leg mating means 42, 42''' is preferably a customized channel 43 or one or more customized openings integrally formed in upper peripheral portions of the side walls 23, 24 or 22, 23, 24, 26 of the base 25 as illustrated. The channel 43 or openings are customized in that the channel 43 or openings are formed in a correspondingly mating shape as the leg 33, 37. The at least one leg 33, 37 and the mating means 42 in combination securely locking the upper and lower lips 31, 36 to the base 25. As illustrated in FIGS. 3–4, the leg 33, 37 for each respective lip 31, 36 can be a single elongate leg that extends substantially the lateral extent of the respective lip 31, 36. Alternatively, as illustrated in the embodiment of a waterfall apparatus 20''' of FIGS. 9–10, the at least one leg can be a plurality of spaced-apart legs 33''', 37'''. It will also be understood that various other leg arrangements or combinations thereof can also be advantageously used according to the present invention.

FIGS. 1–11 also advantageously illustrate various methods according to the present invention. A method of controlling water flow so as to form a waterfall or waterfall apparatus 20 of the present invention preferably includes supplying a stream of water into a water basin or base 25 which includes a bottom 21 and a plurality of side walls 22, 23, 24, 26 and breaking the stream of water with a water flow guiding arm 50 extending downwardly from an upper portion of at least one of the plurality of side walls 22, 23, 24, 26 at a predetermined angle a therefrom in combination with a screen extending from a distant end of the guiding arm and contacting the inner walls proximate the bottom 21 and a side wall, such as side wall 24. The predetermined angle a is preferably less than 90 degrees. The method also preferably includes filling the water basin 25 with the stream of water so that water slowly fills the basin 25 from a lower portion thereof and upwardly therefrom and allowing water to exit from an outlet 28 of the water basin 25 in a relatively smoothly flowing stream to a pool of water positioned at a lower elevation than the water outlet 28 (see, e.g., FIGS. 5–8).

Another method of forming a waterfall according to the present invention preferably includes integrally forming a water flow guiding arm 50 as a single piece to an interior surface of a water basin 25, e.g., by a molding process such as understood by those skilled in the art. The water flow guiding arm 50 is preferably positioned to extend outwardly from the interior surface at a predetermined angle a therefrom. The predetermined angle a is preferably less than 90 degrees. The method further includes integrally forming a concave shaped screen, extending from a distant end of the guiding arm and contacting a side wall proximate the base 21. The method can also advantageously include securely locking respective detachable upper and lower lips 31, 36 to upper peripheries of the water basin 25 in a spaced-apart relation so as to define a water outlet region 29 of the water basin 25.

Yet another method of forming a waterfall according to the present invention preferably includes securely locking respective detachable upper and lower lips 31, 36 to upper peripheries of a water basin 25 in a spaced-apart relation so as to define a water outlet region 29 of the water basin 25 to thereby allow water to flow therefrom to a pool of water. The water outlet region 29 is preferably positioned at a higher elevation than the pool. The method also preferably includes supplying water to a water inlet 27 of the water basin 25 so that the water flow path is broken by a guiding arm 50 and screen 60 positioned within the basin 25 and flows outwardly from the water outlet region 29 to the pool of water.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. A waterfall apparatus comprising:

a water confining base, said base including a bottom and a plurality of upwardly extending side walls connected to said bottom, a first one of said plurality of side walls extending upwardly from said bottom a greater distance than a second one of said plurality of side walls;

a water inlet connected to a lower portion of the base for providing a path of travel for water entering said base;

a water outlet connected to an upper portion of said base, said water outlet including an upper lip connected to the first one of said plurality of side walls and extending outwardly therefrom, and a lower lip spaced-apart from said upper lip, connected to said second one of said plurality of side walls, and extending outwardly therefrom so that water positioned within said base flows between said upper and lower lips and outwardly and downwardly therefrom;

a water flow guiding arm connected to an upper portion of one of said plurality of side walls of said base and extending downwardly at a predetermined angle therefrom into the inner confines of said base to provide a water flow path of travel from said water inlet, around said guiding arm and from said water outlet, the predetermined angle being less than 90 degrees;

a screen extending from said guiding arm and transversely extending to said base.

2. An apparatus as defined in claim 1, wherein said lower lip includes portions which extend inwardly into the inner confines of said base so that water flows from said water inlet, around said guiding arm, through said screen, around said inwardly extending portions of said lower lip and outwardly through said water outlet.

3. An apparatus as defined in claim 1, further comprising lip detachable connecting means connected to each of said upper and lower lips and said base for detachably connecting each of said upper and lower lips to said base.

4. An apparatus as defined in claim 3, wherein said lip detachable connecting means includes at least one leg connected to and extending outwardly from each of said upper and lower lips, said at least one leg including a relatively narrow proximal portion and a relatively thicker distal portion and leg mating means formed integrally with the first and second ones of the plurality of side walls for matingly receiving said at least one leg, and wherein said at least one leg and said mating means in combination securely lock said upper and lower lips to said base.

5. An apparatus as defined in claim 4, wherein said at least one leg comprises a plurality of legs.

6. An apparatus as defined in claim 3, wherein said screen is removable when said upper lip is detached.

7. An apparatus as defined in claim 1, wherein said screen connects to a distal portion of said guiding arm at a first end and connects to said base at a second end.

8. An apparatus as defined in claim 1, wherein said screen is folded to form a concave shape having an apex and two ends.

9. An apparatus as defined in claim 8, wherein said apex extends to said base.

10. An apparatus as defined in claim 8, wherein said apex extends to one of said plurality of side walls.

11. An apparatus as defined in claim 8, wherein an end extends to said guiding arm.

12. An apparatus as defined in claim 1, wherein said screen further comprises a pump in fluid communication with said water inlet, said base, and said water outlet for pumping fluid therethrough.

13. An apparatus as defined in claim 1, wherein said guiding arm is a single integral piece with said first one of said plurality of said side walls and extends from said first one of said plurality of said side walls.

14. A waterfall apparatus comprising:

a water confining base, said base including a bottom and a plurality of upwardly extending side walls connected to said bottom;

a water inlet connected to said base for providing a path of travel for water entering said base;

a water outlet connected to said base, said water outlet including an upper lip connected to at least a first one of said plurality of side walls and extending outwardly therefrom, and a lower lip spaced apart from said upper lip, connected at least to a second one of said plurality of side walls, and extending outwardly therefrom so that water positioned within said base flows between said upper and lower lips and outwardly and downwardly therefrom;

a water flow guiding arm connected to said base and extending downwardly at a predetermined angle therefrom into the inner confines of said base to provide a water flow path of travel from said water inlet, around said guiding arm and from said water outlet, the predetermined angle being less than 90 degrees; and a concave screen with an apex and two ends, said apex extends to said bottom and one of said ends contacts said water flowing guiding arm.

15. An apparatus as defined in claim 14, wherein said lower lip includes portions which extend inwardly into the inner confines of said base so that water flows from said water inlet, around said guiding arm, around said inwardly extending portions of said lower lip and outwardly through said water outlet.

16. An apparatus as defined in claim 15, further comprising lip detachable connecting means connected to each of said upper and lower lips and said base for detachably connecting each of said upper and lower lips to said base.

17. An apparatus as defined in claim 16, wherein said lip detachable connecting means includes at least one leg connected to and extending outwardly from each of said upper and lower lips, said at least one leg including a relatively narrow proximal portion and a relatively thicker distal portion and leg mating means formed integrally with the first and second ones of the plurality of side walls for matingly receiving said at least one leg, and wherein said at least one leg and said mating means in combination securely lock said upper and lower lips to said base.

18. An apparatus as defined in claim 17, wherein said at least one leg comprises a plurality of spaced-apart legs.

19. A method of controlling water flow so as to form a waterfall, the method comprising:

providing a water confining base, said base including a bottom and a plurality of upwardly extending side walls connected to said bottom;

providing a water inlet connected to said base for providing a path of travel for water entering said base;

providing a water outlet connected to said base, said water outlet including an upper lip connected to at least a first one of said plurality of side walls and extending outwardly therefrom, and a lower lip spaced apart from said upper lip, connected at least to a second one of said plurality of side walls, and extending outwardly therefrom so that water positioned within said base flows between said upper and lower lips and outwardly and downwardly therefrom;

providing a water flow guiding arm connected to said base and extending downwardly at a predetermined angle therefrom into the inner confines of said base to provide a water flow path of travel from said water inlet, around said guiding arm and from said water outlet, the predetermined angle being less than 90 degrees;

providing a concave screen with an apex and two ends, said apex extending to said bottom and one of said ends contacting said water flowing guiding arm;

supplying a stream of water into said base;

breaking said stream of water with said water guiding arm and said screen;

filling the water base with the stream of water so that water slowly fills the base from a lower portion thereof and upwardly therefrom;

trapping debris behind said screen; and allowing water to exit from an outlet of water base in a relatively smoothly flowing stream to a pool of water positioned at a lower elevation than the water outlet.

20. A method as defined in claim 19, further comprising generating a plurality of bubbles in the water within the water basin by the use of said screen positioned therein.

* * * * *